United States Patent [19]

Andersen et al.

[11] Patent Number: 4,787,450

[45] Date of Patent: Nov. 29, 1988

[54] GAS LIFT PROCESS FOR RESTORING FLOW IN DEPLETED GEOTHERMAL RESERVOIRS

[75] Inventors: Gregory R. Andersen, Whittier; Stephen D. Pye, Brea; Alice A. Probst, Fullerton, all of Calif.

[73] Assignee: Union Oil Company of California, Los Angeles, Calif.

[21] Appl. No.: 47,851

[22] Filed: May 7, 1987

[51] Int. Cl.[4] ..... E21B 41/02; E21B 43/00; E21B 43/40

[52] U.S. Cl. ..... 166/267; 60/641.2; 166/242; 166/372; 166/902; 166/285

[58] Field of Search ..... 166/242, 267, 285, 372, 166/902; 60/641.2, 641.3, 641.4, 641.5; 417/54, 55, 118

[56] References Cited

U.S. PATENT DOCUMENTS

| | | | |
|---|---|---|---|
| 3,014,533 | 12/1961 | Moore, Jr. | 166/372 X |
| 3,050,121 | 8/1962 | Garrett et al. | 166/285 |
| 3,722,589 | 3/1973 | Smith et al. | 166/250 |
| 3,732,035 | 5/1973 | Szilas et al. | 417/143 |
| 3,782,468 | 1/1974 | Kuwada | 166/267 |
| 4,017,120 | 4/1977 | Carlson et al. | 166/372 X |
| 4,057,964 | 11/1977 | Hutchinson | 60/641.5 |
| 4,059,156 | 11/1977 | Berg | 166/372 |
| 4,189,923 | 2/1980 | Berg | 166/372 X |
| 4,245,698 | 1/1981 | Berkowitz | 166/902 X |
| 4,357,802 | 11/1982 | Wahl, III et al. | 60/641.5 |
| 4,364,232 | 12/1982 | Sheinbaum | 166/372 X |
| 4,576,006 | 3/1986 | Yamaoka | 60/641.5 |
| 4,674,572 | 6/1987 | Gallus | 166/285 |

FOREIGN PATENT DOCUMENTS 1087517 10/1980 Canada .
1096768 3/1981 Canada .

OTHER PUBLICATIONS

Miller, H. C., "Gas-Lift Method of Flowing Oil Wells", Bureau of Mines, *Bulletin* 323, 1930.

"High Pressure Gas Lift for Deep Sour Production," R. J. Dickens, 60th Annual SPE of AIME Technical Conference (Las Vegas, Nev., Sep. 22 to 25, 1985), Preprint No. SPE 14347.

"Buchan Alpha Platform Gets Gas Lift Facilities Fitted at Loch Kishorn on Time," Petrol Times, vol. 89, No. 2185, pp. 12, 13, 16, 18 and 20, Apr. 1985.

"Continuous Removal of Liquids from Gas Wells by Use of Gas Lift," Praisnar, A., Jrl, Trammel, P., 26th Annual Southwestern Petroleum Short Course Association, Inc. et al. Meeting (Lubbock, Tex., Apr. 19 to 20, 1979), Proceedings, pp. 139-145, 1979.

"Completion of Producing Geothermal Wells," Proceedings of the United Nations Symposium on the Development and Utilization of Geothermal Resources, vol. 2, Part 1, pp. 757-763.

*Primary Examiner*—George A. Suchfield
*Attorney, Agent, or Firm*—G. Wirzbicki

[57] ABSTRACT

A method is provided whereby continuous injection of lift gas into a producing geothermal well, preferably from a liquid-dominated reservoir, increases production flow of geothermal fluids from the well by initiating a steam distillation effect within the wellbore. Apparatus is also provided for continuously injecting the lift gas during production from the well.

31 Claims, 3 Drawing Sheets

GAS LIFT PROCESS FOR RESTORING FLOW IN DEPLETED GEOTHERMAL RESERVOIRS

BACKGROUND OF THE INVENTION

This invention relates to a process for gas-lifting fluids from within a well penetrating a subterranean formation. More particularly it relates to a process for gas-lifting fluids from within a well penetrating a liquid-dominated geothermal formation depleted by loss of pressure or fluid enthalpy.

Dissolved hydrocarbon gases present in the liquid phase in petroleum reservoirs are known to enhance recovery of oil by decreasing the density of the oil and decreasing the pressure differential within the wellbore for a given flowrate. The natural "lift" provided by dissolved gases facilitates recovery in the phase referred to as primary oil recovery or "solution gas drive." However, the natural "lift" provided by dissolved hydrocarbon gases during solution gas drive ceases as soon as the gases come out of solution, which is normally early in the life of the reservoir.

Injected gases have been used to simulate the lift effect of reservoir gases in a number of different situations. For instance, to prolong the high productivity levels achieved during the early stages of reservoir production, it is known to inject compressed gases, such as nitrogen, into the fluids in the wellbore. The injected gases simulate the "lifting" action of dissolved reservoir gases and thereby prolong the period of high oil production. Injection of light gases to increase production of fluids from reservoirs has also been used successfully in gas and water reservoirs. The process is typically referred to as "gas lift" because injected light gases generally reduce the density of the reservoir fluid while also increasing pressure in the wellbore, just as naturally occurring reservoir gases do. The increased wellbore pressure exerts sufficient additional pressure differential in the wellbore to push or "lift" reservoir fluids from the well. But injection of gases into a highly pressured well poses technical and practical difficulties.

To overcome the difficulties of providing compressed gases for injection into a highly pressured well, a liquid capable of generating a gas within the wellbore upon contact with reservoir fluids can be employed. U.S. Pat. No. 4,410,041 to Davies et al. discloses a procedure for generating nitrogen gas in situ from an aqueous liquid solution injected into the wellbore. To draw reservoir fluids from the wellbore, the gas-generating solution is injected as nearly as possible at the depth where production fluids are being extracted. The reduced density of fluids at the production zone in the wellbore caused by generation of gases enhances the flow of fluids out of the reservoir.

Gas lift has also been used to "kick-off" production from a gas well that is dead due to a head of liquid standing in the wellbore generating hydrostatic pressure. Injected "lift" gases are used to displace sufficient liquid from the well to reduce the hydrostatic pressure to a level less than the pressure exerted by production gases. Either compressed gases or a gas-generating solution can be employed. A similar procedure can be used to return gas wells to production that have been swamped by water incursions.

However, in producing geothermal wells, gas lift has been considered either useless or too difficult to be practical outside of the limited situation of initiating flow in a dead well. For instance, injection of air or liquid nitrogen has been used to initiate flow in a shallow geothermal well. As a result of the air lift, air-water flow is produced at the wellhead and replacement fluid flows into the well from the feedpoint. If the replacement fluids have sufficient enthalpy, fluids in the wellbore will boil and steam created by the boiling will create a self-sustaining discharge.

In this procedure a flexible rubber tubing is inserted during injection and rapidly retrieved from the well before the flow was built up to full capacity. If not rapidly retrieved, the tubing will usually be blown out of the well by the turbulence and force of the production flow, which can range as high as a million pounds per hour for a geothermal well under full production. Thus, continuous injection of lift gases or gas-producing liquids into producing geothermal wells has not proved feasible using injection tubings.

Beyond the difficulty of the injection tubing being blown out of the well once production is initiated, "gas lift" has been unsuccessful for sustaining normal flowrates in already producing geothermal reservoirs for two additional reasons. First, because production flowrates from geothermal reservoirs are many times as great as from typical petroleum reservoirs, the quantity of injection gases needed to sustain normal flow in most geothermal wells is many times as great as in a petroleum reservoir. Second, the force and turbulence of typical geothermal flow rates requires that continuous injection of gases be conducted at pressures too high to be economical.

An alternative method of increasing flow from depleted geothermal wells is to install downhole pumps. But declining geothermal reservoirs often require that the fluid be lifted from 2000 feet or more below the surface. Current pump design cannot lift from such depths. Moreover, unless the conditions of temperature and pressure in the reservoir are well below those at which flashing could occur in the pump, cavitation would quickly destroy the pump.

Yet the need exists for a method to increase production from depleted geothermal reservoirs. Production flowrates from depleted geothermal reservoirs are much lower than is desirable for economic energy production. Over the production life of a geothermal reservoir, a continuous decrease in reservoir pressure or in fluid enthalpy is usually observed. These changes in reservoir conditions typically cause a decline in production rate sufficient to make continued operation of the wall unprofitable long before its resources have actually been consumed. Accordingly, the need exists for a method of utilizing gas lift injection to increase production from depleted geothermal wells.

SUMMARY OF THE INVENTION

A method is provided for increasing production flow from a geothermal reservoir wherein a sufficient amount of a non-condensible gas is continuously injected into the wellbore during production to increase the fraction of steam in the produced fluids, thereby also increasing recovery of total produced fluids.

DETAILED DESCRIPTION OF THE INVENTION

Figure 1:
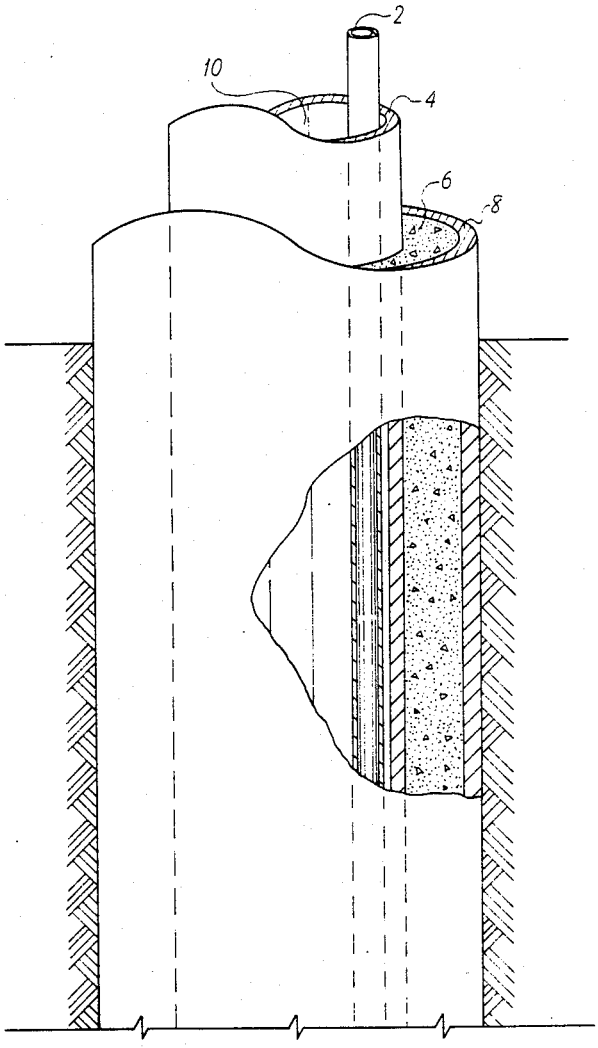

In most geothermal wells the normal mode of sustaining production is to lower pressure in the well just enough to cause flashing of reservoir fluids in the wellbore. Steam generated by flashing provides the gas lift necessary to raise the fluids to the surface. In the case of depleted reservoirs, however, the pressure lost in flashing the brine may render production either impossible or uneconomic. Production by the usual method is impossible if the fluid has too little energy to flash without a large pressure drop. Or production may become uneconomic if the brine, once flashed, is reduced in pressure below the design requirements of the power plant used for energy recovery from the geothermal reservoir.

In the present invention, a method has been discovered whereby continuous injection of noncondensible lift gases, preferably oxygen-free, non-corrosive lift gases, is an effective and economic alternative to pumping fluids from low enthalpy geothermal reservoirs or geothermal reservoirs depleted by production. The flow of produced fluids can thereby be restored or augmented, for example, to meet the design of the power plant, without the pressure losses attendant upon flashing the brine. As used herein, the term "depleted geothermal reservoir" means a predominately single liquid phase reservoir near or below bubble point conditions. While the method can be used in either low pressure or low enthalpy reservoirs with success, it has been found that injection of lift gases is unexpectly more efficient as a means of increasing flow from single phase or liquid-dominated reservoirs having a steam fraction of less than 1 weight percent than in reservoirs that have a greater vapor fraction. Therefore, in the preferred embodiment the fluids entering the wellbore contain a steam fraction of no greater than one weight percent.

The mechanism by which gas lift operates in geothermal reservoirs is different than in other types of reservoirs, such as petroleum, water or gas reservoirs, which operate according to the principle of solution gas drive. In low enthalpy geothermal reservoirs, the fluids entering the wellbore are near or below bubblepoint conditions and are either one phase, i.e., hot water with a negligible vapor phase, or two phase, a predominate water phase with a steam fraction of less than 1 weight percent.

Before the gas injection procedure commences the water and vapor phases are in equilibrium. However, upon injection of a lift gas into the reservoir, equilibrium is disturbed and must be spontaneously re-established to accommodate the injected gases. In other words, the partial pressure of the steam in the vapor phase is sufficiently decreased by the addition of the injected gases that the fraction of steam in the vapor phase must be spontaneously increased at the expense of the liquid phase by the phenomenon known as "steam distillation" to re-establish equilibrium. Upon addition of the lift gas, therefore, additional steam is spontaneously generated within the wellbore by evaporation of liquid to reestablish equilibrium with the liquid phase. Once generated to satisfy the demands of equilibrium in the reservoir, the steam acts together with the injected gases to lower the density of the fluids in the wellbore, thereby decreasing the incremental pressure drop in the wellbore and increasing production rates. Hence in a low enthalpy geothermal reservoir the amount of injection gases needed to increase production of geothermal fluids is far less than would be expected because the reservoir itself distills off a considerable proportion of the "lift" gases in automatic response to the laws of thermodynamics. For this reason, the reduced volume of gas injection needed to sustain or achieve desired production rates has been found to be correspondingly less expensive than was anticipated.

If the fluid at the base of the wellbore is all liquid, flashing and steam distillation will occur at the point the lift gas is injected. The greatest benefit from the gas lift, therefore, is achieved by injecting the lift gas at the base of the wellbore. In this way the entire column of fluid in the wellbore is "lifted" and the maximum increase in production flow can be achieved. If the lift gases are injected near the top of the wellbore, on the other hand, only the upper portion of the column of fluids benefits from the gas lift so that the increase in production is thereby diminished.

During injection, therefore, the lift gases are compressed to a pressure equal to or greater than reservoir pressure at the depth where the gases are to be injected. Preferably, the lift gases are compressed to a pressure equal to or greater than bottomhole pressure and the gases are injected at or near the bottom region of the wellbore. Any convenient means for compressing the lift gases may be used such as reciprocating compressors and the like.

It should be particularly noted that the distillation effect resulting from injection of lift gases is virtually unique to geothermal wells. The amount of injected lift gases required to effect a desired percent of increase in the flowrate is entirely dependent upon the thermodynamics and equilibria of the vapors and liquids in the wellbore. Typical gas, oil, and water producing wells do not involve equilibria in production and will not undergo the distillation effect upon injection of lift gases. A depleted petroleum reservoir, for instance, has typically lost most of its dissolved gases in the solution gas drive phase of the production cycle. Injection of lift gases will not cause additional methane to "distill" from the liquid phase since the gases produced in a petroleum well result from a process of chemical breakdown of kerogen known as "maturation," and do not result from two-phase equilibrium in the wellbore. Hence, the method of gas lifting from geothermal reservoirs near or below bubblepoint conditions taught herein is to be distinguished from methods of utilizing gas lift in wells containing fluids that do not undergo the distillation effect.

It has been found that is depleted geothermal wells gas lift creates greater increases in production flow from wells set into liquid-dominated reservoirs having a negligible steam fraction than from wells set into reservoirs containing a substantial steam fraction. Also, if the fluid is significantly below bubblepoint, the depth of the natural flash point in the wellbore before gas lift will be relatively shallow. When the lift gas is injected at the bottomhole, the flash point is moved to the base of the wellbore so that gas lift operates throughout the entire column of fluids rather than only in the upper portion. Therefore a reservoir below bubblepoint is a particularly good candidate for gas lift injection.

The efficiency of the gas lift process taught herein, therefore, decreases as the fraction of steam in the reservoir fluids prior to injection of lift gases increases. Moreover, it has been found that at some point depending upon conditions of equilibrium in the individual wellbore, the fraction of the already existing vapor phase becomes great enough that injection of lift gases depresses rather than increases production flow. It is believed that this phenomenon, occurs when the volume of gas attempting to pass through the wellbore becomes so great that the pressure drop exerted by the gases essentially cuts off the well. This phenomenon is known as "chokeflow," and if the vapor fraction becomes great enough, flow from the well can be entirely chocked off. However, it has been found generally that substantially increased production flow can be anticipated from injection of lift gases so long as the produced steam fraction prior to initiation of gas lift is substantially below that at which chokeflow occurs. The best results occur when the steam fraction is negligible, i.e., in a liquid-dominated geothermal reservoir having a steam fraction of no greater than 1 weight percent, for example, a low enthalpy reservoir which has been cooled by incursion of cold water.

In the practice of this invention the lift gas is any noncondensible gas, preferably an inert or non-corrosive and oxygen-free, non-condensible gas such as nitrogen, helium, hydrogen, krypton, argon, or natural gas, with nitrogen being preferred. The lift gas is injected during production into the wellbore of a depleted geothermal reservoir to substantially increase wellhead pressure production flowrates, as for example, to the flowrate required by the energy producing facility to which the geothermal fluids are fed for energy recovery. The lift gases are circulated out of the wellbore with the production fluids and are preferably recovered for recycle to conserve consumption of the lift gas. It is preferred that the inert, non-condensible gas injected into a geothermal reservoir be free of elemental oxygen since the presence of oxygen in injection gases drastically increases corrosion and scaling in the wellbore and in surface equipment and piping. Acid gases, such as carbon dioxide and hydrogen sulfide, are particularly to be avoided since they will promote acid corrosion although these gases occur naturally in the reservoir fluids and become a component of the lift gas if it is recycled.

With reference now to the drawing, the method of restoring production flow in a geothermal well by injection of lift gases herein requires continuous injection of lift gases without allowing the injection tubing to be blown out of the hole by the turbulent forces in the production string. In the case of an already producing geothermal reservoir with wellstring in place, when production declines and injection of lift gases is needed to restore flow, the lift gas conduit must be inserted down the already existing wellstem as shown in FIG. 1. In this situation lift gas conduit 2 is inserted inside the already existing wellstring consisting of inner casing 4, cement liner 6, and outer casing 8. To present the least possible obstruction to the flow of produced fluids in the wellstring, the lift gas conduit is inserted adjacent to interior surface 10 of inner casing 4. Lift gas conduit 2 is typically constructed of metal conduit to provide sufficient strength and durability to withstand forces in the wellbore, but any comparable material can be used. Lift gas conduit 2 must be small enough to avoid unduly obstructing the flow of produced fluids up the wellstring, yet large enough in diameter to provide strength and accommodate the flowrate of lift gases needed to restore the desired flow of produced fluids.

Typically, outer casing 8 of a geothermal wellstring varies in size between about 7⅞ inches and 22 inches in internal diameter and between 8⅝ and 24 inches in external diameter. The internal diameter of inner casing 4 typically varies between about 6¼ and 19 inches and the external diameter varies between about 7 and 20 inches in diameter with the external diameter of the inner casing being selected to be smaller than the internal diameter of the outer casing so as to create an annulus therebetween. The external diameter of gas lift conduit 2 usually varies in size between about 2 and 2⅜ inches, while the internal diameter normally varies between about 1.5 and 2½ inches. Preferably the ratio of the diameters of the exterior of the gas lift conduit and the interior of the inner casing is between about 1:3.125 and 1:8.

Selection of the optimum size and material for the gas lift conduit is generally determined by three factors: (1) the desired flowrate of the lift gases, (2) the strength the gas lift conduit must have to withstand the forces in the wellstem, and (3) the corrosivity of the reservoir fluids. For a geothermal reservoir having relatively non-corrosive fluids, gas lift conduit 2 can be constructed of carbon steel conduit. But if the geothermal fluids contain sufficient corrosive constituents, such as hydrogen sulfide and chloride ion, to be corrosive to carbon steel conduit at the temperature of the reservoir, a more corrosion resistant alloy should be employed.

Figure 2:
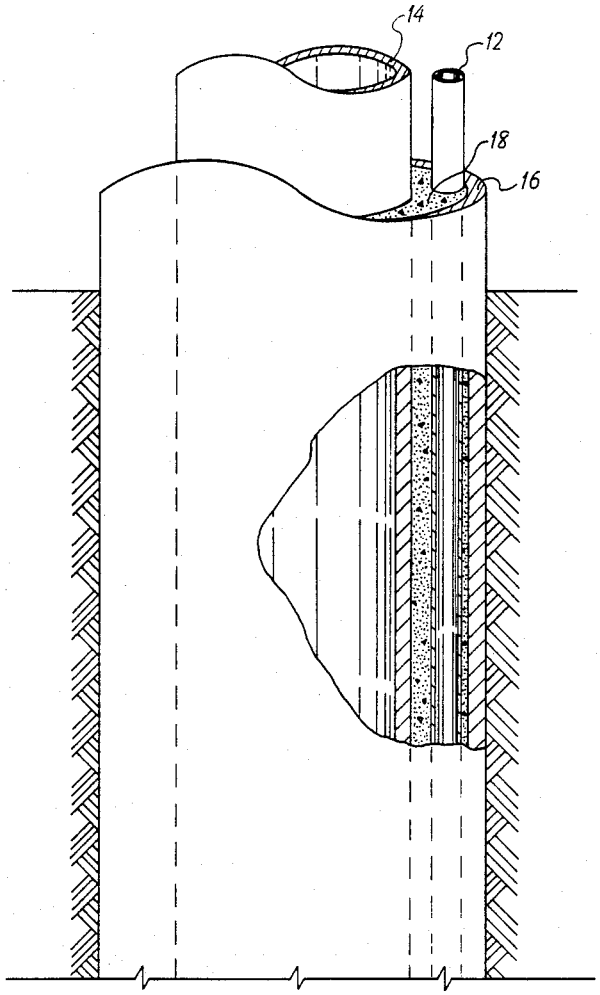

Preferably, however, the lift gas conduit is not installed into an already producing reservoir, but is put into place when the wellbore is first drilled and lined with casing. In this preferred embodiment of the invention, as depicted in FIG. 2, lift gas conduit 12, called the "parasite string," is placed into an annulus created by placing inner casing or liner 14 concentrically within outer casing 16. Parasite string 12 is cemented into place in the annulus between inner casing 12 and outer casing 14 by cement liner 18 so as to provide additional stability to parasite string 12. Generally, in this embodiment, therefore, the external size of parasite string 12 is limited by the size of the annular diameter between the exterior of inner casing 14 and the exterior of outer casing 16, which have the same respective ranges of internal and external diameters as inner casing 4 and outer casing 8 in FIG. 1. In general, parasite string 12 need be no greater than is required to accommodate the desired mass flowrate of the lift gases since success of the continuous injection scheme does not depend upon the conduit being large enough to provide strength sufficient to withstand the turbulent forces within the wellstem. Also, because parasite string 12 does not come into contact with reservoir fluids in this embodiment, a corrosion resistant alloy need not be used. Generally, the internal diameter of the parasite string should be no smaller than about 1½ inches. If needed to accommodate a large flow of gases, a plurality of parasite strings can be positioned within the annulus, each preferably being surrounded by cement.

For example, an external casing with an internal diameter of 15 inches having a concentrically positioned inner liner with an external diameter of 10¾ inches creates an annulus sufficient to accommodate a lift gas conduit having an internal diameter of about 1½ inches and an external diameter of about 2 inches. A conduit of this diameter can readily accommodate a mass flowrate of nitrogen of 9000 pounds per hour at an injection temperature of 450° F. and pressure of 400 p.s.i.g.

Figure 3:
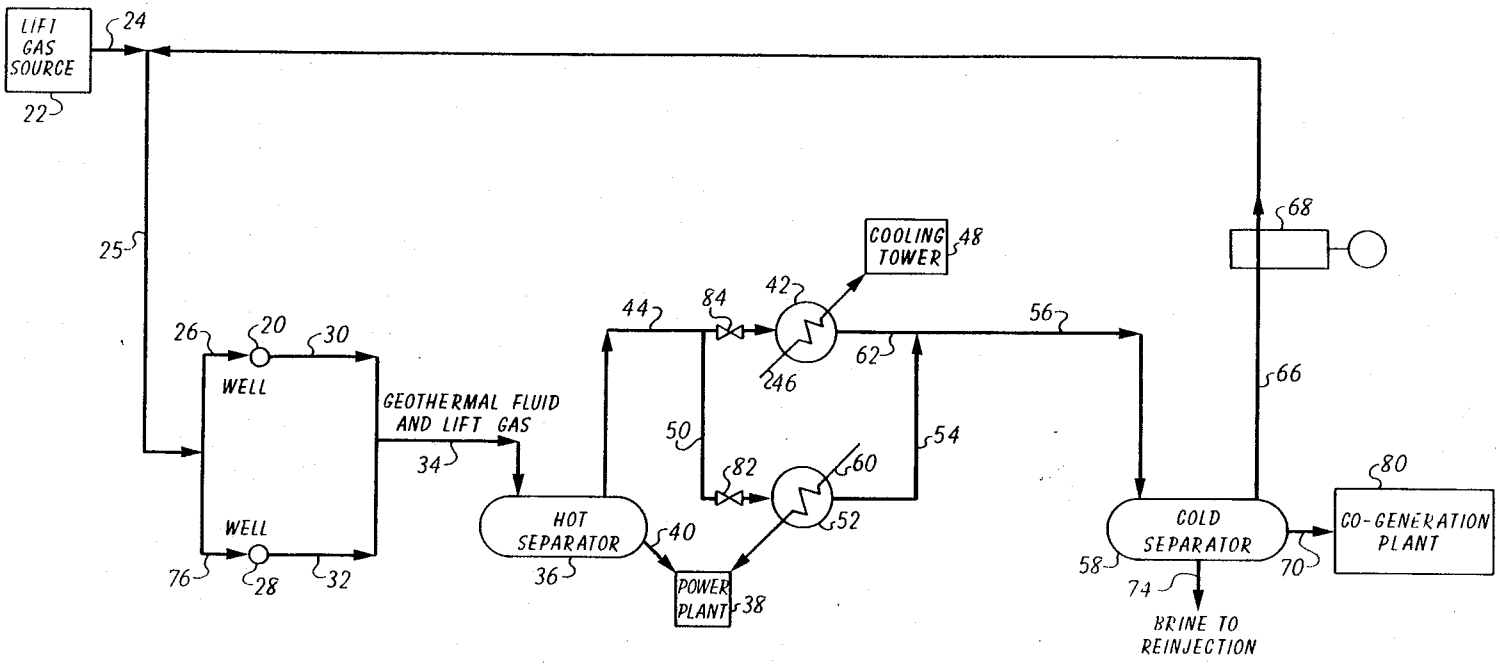

As shown in FIG. 3, during injection lift gases are supplied from lift gas source 22 to wellheads 20 and 28 via gas lift conduits 24, 25, 26, and 76. Geothermal fluids and lift gases are recovered from wellheads 20 and 28 via conduits 30 and 32, respectively, which join into conduit 34. From conduit 34 the recovered geothermal fluids and lift gases pass into hot separator 36, wherein the hot brine separates from the steam and lift gases, the brine passing therefrom to geothermal power plant 38 via conduit 40, and the steam and lift gases passing to heat exchanger 42 through valve 84 via conduit 44. In one embodiment of the invention, the steam in the recovered gas is condensed by heat exchange in heat exchanger 42 with a stream of cold water carried in conduit 46 through heat exchanger 42 and exits therefrom to a location where the heat is released to the atmosphere in cooling tower 48. Alternatively, heat released from the stream of heated water leaving heat exchanger 42 via conduit 46 can be put to useful purposes, such as space heating, and the like. In either embodiment the water must be completely condensed out of the lift gas before it is sent to compressor 68 for repressurization.

If the geothermal energy recovery plant employs a binary heat exchange system to recover heat from geothermal waters, rather than directly powering the turbines with steam produced from the reservoir, it is preferred that the stream of steam and hot lift gases be used to heat the working fluid of the binary geothermal power plant before the binary heat exchange medium (usually an organic refrigerant) passes to the turbines of the power plant. In the preferred embodiment, therefore, valve 84 is closed and the steam and hot lift gases pass from conduit 44 to conduit 50, through valve 82 and into heat exchanger 52 wherein the steam is completely condensed by giving up heat to a stream containing the working fluid of binary power plant 38 contained in conduit 60, which thereafter is sent to the turbines in power plant 38 for energy recovery.

The cooled stream of condensed steam and lift gas vapors passes from heat exchanger 42 via conduit 62, or, in the preferred embodiment, from heat exchanger 52 via conduit 54 into conduit 56 leading to cold separator 58 where the condensed steam separates from the cooled gas lift vapors. From separator 58 the cooled gas lift vapors are sent via conduit 66 to compressor 68 to be repressurized to injection pressure and the condensed brine is sent via conduit 74 to a reinjection well (not shown) for reinjection into the reservoir. The pressurized lift gases recycle to wells 20 and 28 via conduit 25 and conduit 26 or 76, respectively, for reinjection as lift gases.

In yet another embodiment of the invention, methane and/or other combustible natural gases are used as the lift gases. The natural gases are injected as lift gases into the geothermal reservoir, recovered with the produced gases, and then separated out by removing sufficient heat through heat exchange to condense out the water vapor while the heat of vaporization is salvaged as described with reference to FIG. 3 above. However, in this embodiment of the invention, the recovered natural gases are not recycled for use as injection gases, but are sent from separator 58 via conduit 70 to a co-generation plant 80 to be used as fuel for making electricity. Due to current government subsidies for cogeneration schemes, it may prove more cost effective to use natural gases as the lift gas in conjunction with a co-generation scheme than to employ other less expensive lift gases, particularly if a natural gas well is located within a convenient distance of the geothermal site.

Although the invention can be practiced by routinely injecting lift gases into the reservoir and determining whether the net production flowrate has been augmented thereby, the appropriate amount of dissolved inert gas needed to increase production of fluids to desired flowrates is usually determined by either of two procedures. The first procedure is useful for making the determination based solely on data available in the field, or on site. First, the surface vapor fraction of the produced fluids should be determined to assure that the fraction of vapors in the produced fluids is not so large as to approach "chokeflow" conditions. The flowrates of liquid and gases can be measured using a well head separator for separation of steam from brine and metering the liquid phase output. If the requirement for wellhead pressure and flowrate is known, injection of lift gases should be commenced and incrementally increased until the desired liquid phase flowrate is attained. Economic calculations can be used to determine whether the amount of injection gas needed to meet design requirements is economically feasible for any given well.

A second method for determining the amount of inert injection gas required to meet a desired wellhead pressure and production flowrate utilizes a wellbore simulator computer program. This method utilizes a computer model that incorporates two-phase flow correlations and an energy balance which allows for heat losses to the reservoir. A model of this kind is used to calculate the incremental two-phase flowrate that results from injection of incremental amounts of lift gases at given bottom hole and wellhead pressures, temperatures, and steam fraction in the geothermal fluids. The model, which uses as a base the depleted flowrate of the reservoir just prior to injection of lift gases, calculates the weight percent of produced injection gases in the total flow of produced fluids. The injection rate of lift gases required to generate the corresponding total flowrate is then known by assuming that the flow of lift gases into the reservoir equals the flow of lift gases out of the reservoir. The weight percent of injection gasses in the total produced fluids in the model is increased incrementally to determine what mass flowrate of injected gases will be required in actual use to achieve the target percent increase in production flow or the target rate of produced brine.

The computer model can also be used to calculate the pressure in the wellbore at any given depth. The injection pressure for the lift gases is the pressure in the reservoir at the depth where the lift gases are to be injected. Preferably, the bottomhole pressure should be used as the injection pressure for the lift gases.

The following examples illustrate the method of calculation and the results achieved using a wellbore simulator computer program for four distinct types of reservoir conditions. The examples are illustrative of specific modes of practicing the invention and are not intended to limit the scope of the invention as defined by the appended claims.

EXAMPLE 1

Example 1 simulates the case in which production loss is caused by an enthalpy decline as would be caused by a cold water incursion into a geothermal well. The percent of increase in the production rate over the initial depleted flowrate was calculated using a reservoir modeling computer program to simulate the case of a single phase liquid geothermal reservoir. Before enthalpy decline the surface mass flowrates were as follows:

total: 122,000 pounds/hr.
sodium chloride: 0.7 weight percent
carbon dioxide: 0.45 weight percent The experiment simulates a well having a depth of 6650 feet. The depleted bottomhole and surface pressures were 800 and 165 p.s.i.g., respectively, and the bottomhole and surface temperatures were 472° and 372° F., respectively. The initial fraction of steam was zero at the bottomhole and 13.3 weight percent at the surface. The lift gas was nitrogen and the flash point within the wellbore before injection of lift gas was at a depth of 6200 feet.

The effect of nitrogen injection was simulated by maintaining the surface pressure at 165 p.s.i.g. while incrementally increasing the mass flowrate. The model predicts for each increment the total amount of vapor existing at the bottom of the wellbore after the steam distillation effect establishes a new equilibrium as shown in Table 1, in the column entitled "Wt.% Vapor After $N_2$." In this example, injection of only 0.15 weight percent of nitrogen based on the total production flow increases total production flow by 75% as is shown in Table 1.

TABLE 1

PRODUCTION INCREASES FROM NITROGEN INJECTION INTO SINGLE PHASE RESERVOIR

| | | | Surface Conditions | | | |
|---|---|---|---|---|---|---|
| Prod. Rate % Orig. Flow | $N_2$ Wt. % of Total Flow | Wt. % Vapor After $N_2$ | Wt. % Total Vapor | Wt. % Vapor w/o $N_2$ | Temp. (°F.) | Pressure (p.s.i.g.) |
| 100 | — | — | 13.3 | 13.3 | 372 | 165 |
| 175 | .15 | 0.6 | 13.5 | 13.4 | 372 | 165 |
| 250 | .30 | 1.1 | 13.8 | 13.5 | 370 | 165 |
| 350 | .80 | 3.0 | 14.2 | 13.4 | 370 | 165 |
| 450 | 1.6 | 3.8 | 15.4 | 13.8 | 365 | 165 |
| 500 | 3.2 | 6.4 | 17.4 | 14.2 | 359 | 165 |

The increase in flow from a single phase reservoir was relatively sensitive to the gas lift effect since only 0.30 weight percent of nitrogen increased the depleted flowrate by 250 percent.

EXAMPLE 2

In Example 2 the reservoir simulation computer program was used to simulate the case of a single phase geothermal reservoir having a depth of 3326 feet with the flash point before nitrogen injection located at a depth of 2400 feet. The depleted pressures in the wellbore were 800 p.s.i.g. at the bottom and 190 p.s.i.g. at the surface, and the temperatures were 437° F. at the bottom and 384° F. at the top. The depleted flowrate was 300,000 pounds per hour. The weight percent of steam in the reservoir fluids before nitrogen injection was zero at the bottom and 7.3 weight percent at the top of the wellbore.

The effect of nitrogen injection was again simulated by holding the surface pressure of the model constant and incrementally increasing the mass flowrate to determine what weight percent of the produced fluids would have to be nitrogen to achieve each flowrate.

In this example, as is shown in Table 2, a 100 percent increase in flowrate of produced fluids results from injection of only 0.1 weight percent of nitrogen.

TABLE 2

PRODUCTION INCREASES FROM NITROGEN INJECTION INTO SINGLE PHASE GEOTHERMAL WELL WITH MODERATE ENTHALPY DECLINE

| | | | Surface Conditions | | | |
|---|---|---|---|---|---|---|
| Prod. Rate % Orig. Flow | $N_2$ Wt. % of Total Flow | Wt. % Vapor After $N_2$ | Wt. % Total Vapor | Wt. % Vapor w/o $N_2$ | Temp. (°F.) | Pressure (p.s.i.g.) |
| 100 | — | — | 7.3 | 7.3 | 384 | 190 |
| 200 | 0.1 | 0.3 | 7.5 | 7.4 | 384 | 190 |
| 300 | 0.2 | 0.5 | 7.8 | 7.6 | 383 | 190 |
| 400 | 0.3 | 0.7 | 8.0 | 7.7 | 383 | 190 |

This example illustrates that a single phase reservoir significantly below bubblepoint conditions shows a large increase in total produced fluids at relatively low rates of injected lift gases, and is, therefore, a good candidate for gas injection to increase production flowrates because the flash point was lowered from 2400 to 3326 feet in the wellbore.

EXAMPLE 3

In this example the reservoir simulator was used to model the case of a geothermal reservoir having a vapor fraction of 1.0 weight percent before injection of lift gas, but a high surface pressure. The depleted mass flow of fluids is 200,000 pounds per hour, the depth of the wellbore was 3326 feet. The reservoir steam fraction before gas lift was 1 weight percent at bottomhole and 9.8 weight percent at the surface. The initial pressures in the wellbore were 800 p.s.i.g. at the bottom and 400 p.s.i.g. at the surface, and the initial temperatures were 509° F. at the bottom and 446° F. at the top.

The results shown in Table 3 indicate that injection of lift gases into a wellbore having the combination of a high wellhead pressure and a substantial gas phase would result in hindering production rather than enhancing it.

TABLE 3

PRODUCTION INCREASE FROM NITROGEN INJECTION INTO TWO-PHASE, HIGH PRESSURE GEOTHERMAL WELL

| Prod. Rate % Orig. Flow | $N_2$ Wt. % of Total Flow | Wt. % Vapor After $N_2$ | Surface Conditions Wt. % Total Vapor | Wt. % Vapor w/o $N_2$ | Temp. (°F.) | Pressure (p.s.i.g.) |
|---|---|---|---|---|---|---|
| 100 | — | 1.0 | 9.8 | 9.8 | 446 | 400 |
| 90 | 0.2 | 2.3 | 9.9 | 9.7 | 446 | 400 |
| 75 | 0.5 | 3.5 | 10.6 | 10.1 | 446 | 400 |

Instead of undergoing an increase in the rate of production, the well flowrate would actually decline when lift gases are injected. The decline is directly proportional to the amount of gas injected and is thought to result from choking off of the well due to the large volume of steam contained therein.

EXAMPLE 4

In this example a two-phase reservoir having a lower wellhead pressure than in Example 3 was simulated. The depleted mass flowrate was 500,000 pounds per hour, the depth of the well was 6652 feet. At bottomhole the temperature was 509° F., the pressure was 800 p.s.i.g., and the vapor fraction was 1 weight percent. At the surface the temperature was 375° F., the pressure was 170 p.s.i.g., and the vapor fraction was 18.9 weight percent.

TABLE 4

PRODUCTION INCREASES FROM NITROGEN INJECTION INTO TWO-PHASE GEOTHERMAL RESERVOIR

| Prod. Rate % Orig. Flow | $N_2$ Wt. % of Total Flow | Wt. % Vapor After $N_2$ | Surface Conditions Wt. % Total Vapor | Wt. % Vapor w/o $N_2$ | Temp. (°F.) | Pressure (p.s.i.g.) |
|---|---|---|---|---|---|---|
| 100 | — | 1.0 | 18.9 | 18.9 | 375 | 170 |
| 108 | 0.25 | 2.5 | 19.4 | 19.2 | 374 | 170 |
| 115 | 1.0 | 5.6 | 20.7 | 19.7 | 372 | 170 |

As shown in Table 4, gas lift provides only slight production enhancement from this well. Although the surface pressure is considerably lower than in Example 3, the large vapor fraction existing at the surface before gas lift was initiated suggests that the increase in flow resulting from gas lift will be moderate.

While particular embodiments of the invention have been described, it will be understood that the invention is not limited thereto since many obvious modifications can be made. It is intended to include within this invention any such modification as will fall within the scope of the appended claims.

We claim:

1. A method for increasing the production flow from a well penetrating a geothermal reservoir from a wellhead, said method comprising:
   (a) continuously injecting a sufficient amount of an inert, non-condensible lift gas into the well during the production of geothermal fluids therefrom to cause a substantial fraction, or to substantially increase a preexisting fraction, of steam in the produced fluids without having to significantly reduce the pressure of the produced fluid at the wellhead; and
   (b) recovering increased produced fluids and the lift gas from the well.

2. The method of claim 1 further comprising:
   (c) separating the lift gas from the produced fluids; and
   (d) recycling the recovered lift gas for reinjection in step (a).

3. The method of claim 1 wherein the lift gas comprises gases selected from the group consisting of hydrogen, nitrogen, krypton, argon, and natural gas.

4. The method of claim 1 wherein the lift gas comprises nitrogen.

5. The method of claim 1 wherein the lift gas comprises methane.

6. The method of claim 1 wherein the lift gas is injected near the bottom of the well at about the pressure in the reservoir at the point of injection.

7. A method for restoring production flow rates from a well penetrating, from a wellhead, a liquid-dominated geothermal reservoir having a pressure near or below the bubblepoint of the fluid in the reservoir, said method comprising:
   (a) continuously injecting a sufficient amount of an inert, oxygen-free, non-condensible lift gas into the well during the production of geothermal fluids therefrom to substantially increase the fraction of steam in the produced fluids without having to significantly reduce the pressure of the produced fluid at the wellhead; and
   (b) recovering increased produced fluids and the lift gas from the well.

8. The method of claim 7 further comprising:
   (c) recovering the lift gas from the produced fluids; and
   (d) recycling the recovered lift gas for reinjection in step (a).

9. The method of claim 8 wherein the lift gas comprises gases selected from the group consisting of hydrogen, nitrogen, krypton, argon and natural gas, and the well is producing at a rate below chokeflow before injection of the lift gas.

10. The method of claim 8 wherein the lift gas comprises nitrogen.

11. The method of claim 8 wherein the lift gas comprises natural gas.

12. The method of claim 10 wherein the lift gas is injected near the bottom of the well at about the pressure in the reservoir at the point of injection.

13. The method of claim 10 wherein the geothermal reservoir is a liquid-dominated reservoir having a stream fraction of no more than one weight percent of the fluids entering the well.

14. A method for increasing the production flow from a well penetrating, from a wellhead, a geothermal reservoir associated with a binary geothermal power plant utilizing a binary heat exchange medium for extracting heat from geothermal fluids, said method comprising:

(a) continuously injecting a sufficient amount of an inert, oxygen-free, non-condensible lift gas into the well during the production of geothermal fluids therefrom to substantially increase the fraction of steam in the produced fluids without having to significantly reduce the pressure of the produced fluid at the wellhead;

(b) recovering increased produced fluids and the lift gas from the well;

(c) separating the lift gas from the produced fluids recovered in step (b) utilizing heat exchange with the binary heat exchange medium of the power plant; and (d) recycling the separated lift gas for reinjection in step (a).

15. The method of claim 14 wherein the lift gas is selected from the group consisting of hydrogen, nitrogen, krypton, argon and natural gas, and the condition of the fluid in the reservoir is at or below bubblepoint prior to injection of lift gas in step (a).

16. The method of claim 14 wherein the lift gas comprises nitrogen.

17. The method of claim 14 wherein the lift gas comprises natural gas.

18. The method of claim 14 wherein the lift gas comprises methane.

19. The method of claim 15 wherein the geothermal reservoir is liquid-dominated, having a steam fraction of less than 1 weight percent of fluids.

20. The method of claim 19 wherein step (c) comprises (1) separating produced brine from produced steam and the lift gas; (2) condensing the produced steam out of the lift gas by heat exchange with the binary heat exchange medium; and (3) recovering the lift gas from the condensed steam.

21. The method of claim 20 wherein the lift gas is injected into the bottom region of the well at a pressure at least as great as the pressure in the well at the point of injection.

22. The method of claim 21 wherein the lift gas is injected via a gas lift conduit inserted down the throat of the wellbore.

23. The method of claim 22 wherein the gas lift conduit has an external diameter of between about 2 and $2\frac{3}{8}$ inches.

24. The method of claim 22 wherein the produced fluids are corrosive and the gas lift conduit is constructed of corrosion-resistant alloy.

25. The method of claim 22 wherein the gas lift conduit lies adjacent to the interior surface of the wellbore.

26. The method of claim 21 wherein a wellstring in the well is comprised of an outer casing and an inner casing placed concentrically within the outer casing so as to form an annulus between the exterior of the inner casing and the interior of the outer casing and the lift gas is continuously injected during production via at least one parasite string located in the annulus, said parasite string opening into the lower region of the wellbore.

27. The method of claim 26 wherein the annulus surrounding the parasite string is filled with cement so as to prevent vibration of the gas lift conduit during injection and production.

28. The method of claim 26 wherein a multiplicity of parasite strings is located in the annulus, said parasite strings opening into the lower region of the wellbore and wherein the annulus surrounding the parasite strings is filled with cement.

29. The method for increasing production flow from a well penetrating a geothermal reservoir having a steam fraction of less than 1 weight percent and being associated with a co-generation plant burning natural gas, said method comprising:

(a) continuously injecting a sufficient amount of a lift gas comprising oxygen-free combustible natural gas into the well during production of geothermal fluids to substantially increase the fraction of steam in the produced fluids;

(b) recovering an increased flow of produced fluids and the lift gas from the reservoir;

(c) separating the lift gas from the produced fluids recovered in step (b); and (d) sending the separated lift gas to the associated co-generation plant to be combusted for the purpose of generating electricity.

30. The method of claim 29 wherein the lift gas is injected into the bottom region of the well at a pressure at least as great as the pressure in the well at the point of injection.

31. The method of claim 30 wherein the lift gas is methane.

* * * * *